US005222722A

United States Patent [19]

Kamano

[11] Patent Number: 5,222,722

[45] Date of Patent: Jun. 29, 1993

[54] PAPER FEED CASSETTE

[75] Inventor: Tadao Kamano, Shizuoka, Japan

[73] Assignee: Tokyo Electric Co., Ltd., Tokyo, Japan

[21] Appl. No.: 830,332

[22] Filed: Jan. 31, 1992

[30] Foreign Application Priority Data

Feb. 8, 1991 [JP] Japan ..... 3-11721

[51] Int. Cl.[5] ..... B65H 3/44

[52] U.S. Cl. ..... 271/9; 271/145; 271/171

[58] Field of Search ..... 271/9, 171, 262, 157, 271/145

[56] References Cited

FOREIGN PATENT DOCUMENTS

| | | | |
|---|---|---|---|
| 3608273 | 9/1987 | Fed. Rep. of Germany | 271/9 |
| 63-147480 | 11/1963 | Japan . | |
| 31226 | 2/1984 | Japan | 271/145 |
| 223737 | 11/1985 | Japan | 271/145 |
| 204229 | 8/1990 | Japan | 271/9 |

*Primary Examiner*—D. Glenn Dayoan
*Assistant Examiner*—Boris Milek
*Attorney, Agent, or Firm*—Oblon, Spivak, McClelland, Maier & Neustadt

[57] ABSTRACT

A fixed cover (7) having a pair of manual feed guides (12) for guiding opposite side edges of manual feed paper (10) is fixedly provided at a front portion of an upper opening of a cassette case (5) in respect of the paper feeding direction. A rotatable cover (8) is located behind the fixed cover (7), and a front end portion of the rotatable cover (8) is vertically rotatably supported to the cassette case (5). Accordingly, the manual feed guides (12) can be located near a paper feed roller in a body of a printer. In feeding the manual feed paper (10) along an upper surface of the fixed cover (7), the inclination of a front end of the manual feed paper (10), which causes skewing, can be prevented. Furthermore, in supplying sheets of paper into the cassette case (5) with the rotatable cover (8) opened, the interference of the front end of the rotatable cover (8) with the sheets can be prevented.

7 Claims, 3 Drawing Sheets

PAPER FEED CASSETTE

FIELD OF THE INVENTION AND RELATED ART STATEMENT

The present invention relates to a paper feed cassette for use with a printer.

Referring to FIGS. 4 and 5 which show a conventional paper feed cassette, reference numeral 1 designates a body of a printer, and reference numeral 13 designates a paper feed cassette. The body 1 is formed with a side hole, and a front end portion of the paper feed cassette 13 in respect of a paper feeding direction is removably mounted in the side hole of the body 1. The paper feed cassette 13 has a cassette case 14 for accommodating a plurality of sheets 4 of paper in a stacked condition and a rotatable cover 16 for covering an upper opening 15 of the cassette case 14. A pair of supporting portions 9 for rotatably supporting the rotatable cover 16 on its opposite sides are provided on the opposite side surfaces of the cassette case 14 at the positions outside of the body 1. A pair of manual feed guides 17 for guiding the opposite side edges of manual feed paper are integrally formed on the upper surface of the rotatable cover 16 at the laterally opposite positions thereof. The body 1 is provided with a paper feed roller 2 for sequentially withdrawing an uppermost one of the sheets 4 accommodated in the cassette case 14. In supplying additional sheets of paper into the cassette case 14, the rotatable cover 16 is rotated upwardly about the supporting portions 9 as shown in FIG. 5. In feeding the sheets 4 into the body 1 one by one, the upper opening 15 of the cassette case 14 is closed by the rotatable cover 16. In case of using a manual feed paper rather than the sheets 4 accommodated in the cassette case 14, the manual feed paper is placed on the upper surface of the rotatable cover 16 and is fed to the paper feed roller 2 in the body 1. At this time, the opposite side edges of the manual feed paper are defined in position by the manual feed guides 17 located at the laterally opposite positions of the rotatable cover 16 on the upper surface thereof.

As mentioned above, the manual feed guides 17 are integrally formed on the upper surface of the rotatable cover 16. Accordingly, when the rotatable cover 16 is opened, the manual feed guides 17 are inclined so that their rear ends are raised. As the front ends of the manual feed guides 17 are located outside the side surface of the body 1, a distance from the front ends of the manual feed guides 17 to the paper feed roller 2 in the body 1 is long. Accordingly, in case of using manual feed paper, there is a possibility that the direction of insertion of the front end of the manual feed paper is inclined with respect to the direction perpendicular to the paper feeding direction. As a result, skewing and jamming to be caused by the skewing tend to occur. To solve this problem, it is considered to extend the front ends of the manual feed guides 17 toward the body 1. In this case, however, when the rotatable cover 16 is opened to supply the sheets 4 of paper, the front ends of the manual feed guides 17 come close to or into contact with a bottom surface of the cassette case 14, causing hindrance of the supply of the sheets 4.

OBJECT AND SUMMARY OF THE INVENTION

It is a first object of the present invention to feed manual feed paper without the occurrence of skewing.

It is a second object of the present invention to insure the insertion of manual feed paper.

It is a third object of the present invention to eliminate the interference of the rotatable cover with sheets of paper upon supplying them into a cassette case.

According to the present invention, there is provided a paper feed cassette comprising: a cassette case having a front end portion in respect of the paper feeding direction adapted to be removably mounted into a side hole of a body of a printer, the cassette case having an upper opening from which a plurality of sheets of paper are to be supplied and accommodated in a stacked condition; a fixed cover fixed to a front portion of the upper opening of the cassette case; a rotatable cover for covering a rear portion of the upper opening of the cassette case behind the fixed cover; a pair of supporting portions located near a rear end portion of the fixed cover for vertically rotatably supporting a front end portion of the rotatable cover on opposite side surfaces thereof; and a pair of manual feed guides located on an upper surface of the fixed cover at laterally opposite positions for guiding opposite side edges of manual feed paper.

With this construction, when the cassette case is mounted into the side hole of the body of the printer, the front ends of the manual feed guides can be located close to the paper feed roller in the body. Accordingly, in feeding the manual feed paper along the upper surface of the fixed cover into the body of the printer, the inclination of the front end of the manual feed paper, which causes the skewing, can be prevented. Furthermore, the rotatable cover can be opened with its rear end raised and with a change in position of its front end prevented. Accordingly, the interference of the front end of the rotatable cover with the sheets of paper can be prevented upon supplying the sheets into the cassette case.

DETAILED DESCRIPTION OF THE PREFERRED EMBODIMENT

Figure 1:
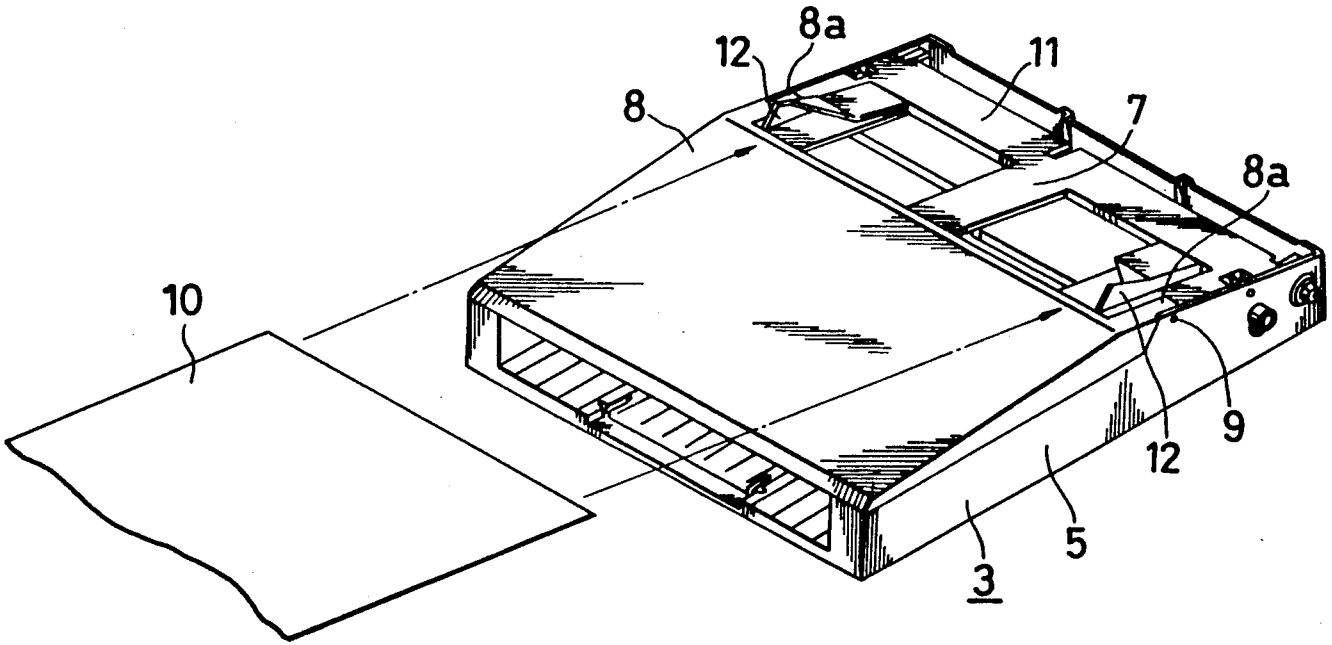
FIG. 1 is a perspective view illustrating a preferred embodiment of the present invention.
Figure 2:
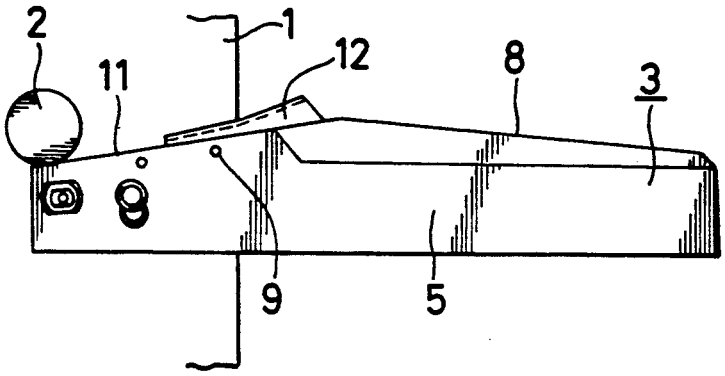
FIG. 2 is a side view of the preferred embodiment.
Figure 3:
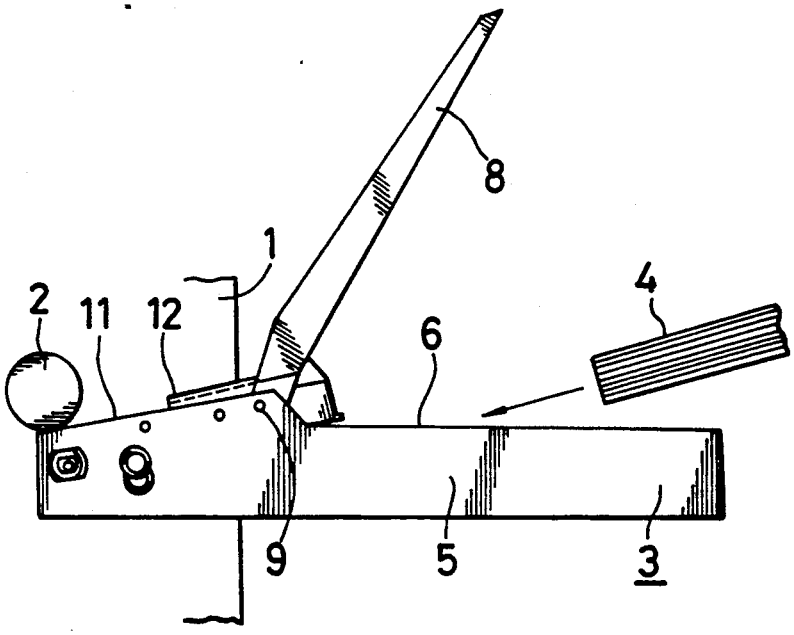
FIG. 3 is a side view of the preferred embodiment, illustrating a condition where sheets of paper are supplied.
Figure 4:
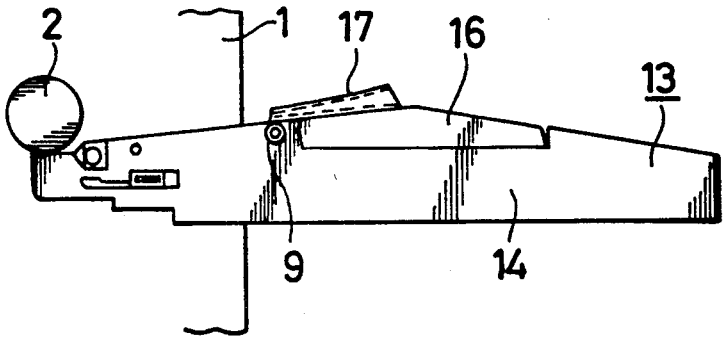
FIG. 4 PRIOR ART
FIG. 4 is a side view illustrating a paper feed cassette in the prior art.
Figure 5:
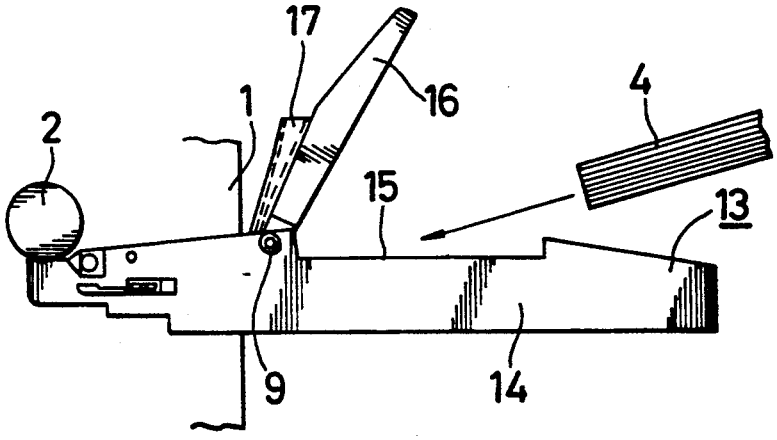
FIG. 5 PRIOR ART
FIG. 5 is a side view of the paper feed cassette in the prior art, illustrating a condition where sheets of paper are supplied.

A preferred embodiment of the present invention will now be described with reference to FIGS. 1 to 3, in which the same parts as those illustrated in FIGS. 4 and 5 are designated by the same reference numerals. Referring to FIGS. 1 to 3, a body 1 of a printer is provided with a side hole, and a front end portion of a paper feed cassette 3 in respect of the paper feeding direction is removably mounted in the side hole of the body 1. The paper feed cassette 3 has a cassette case 5 for accommodating a plurality of sheets 4 of paper in a stacked condition and a fixed cover 7 and a rotatable cover 8 for covering an upper opening 6 of the cassette case 5. The fixed cover 7 is fixed to a front portion of the upper opening 6. The rotatable cover 8 is formed at its front end with a pair of legs 8*a*. A pair of supporting portions 9 are provided on the opposite side surfaces of the cassette case 5 at the positions near a rear end of the fixed cover 7. The legs 8*a* of the rotatable cover 8 are vertically rotatably supported to the supporting portions 9 of the cassette case 5. The upper surface of the fixed cover 7 is provided with a guide surface 11 for guiding a lower surface of manual feed paper 10. A pair of manual feed guides 12 for guiding the opposite side edges of the manual feed paper 10 are integrally formed on the guide surface 11 at the laterally opposite positions.

With the above-mentioned construction, when the cassette case 5 is mounted into the side hole of the body 1 of the printer as shown in FIG. 2, the front ends of the manual feed guides 12 can be located near a paper feed roller 2 provided in the body 1. Accordingly, in feeding the manual feed paper 10 along the guide surface 11 of the fixed cover 7, the inclination of the front end of the manual feed paper 10, which causes the skewing, can be prevented. Furthermore, as shown in FIG. 3, the rotatable cover 8 can be opened with its rear end raised and with a change in position of its front end prevented. Accordingly, the sheets 4 of paper can be supplied into the cassette case 5 without the interference with the front end of the rotatable cover 8.

As described above, the paper feed cassette according to the present invention comprises a cassette case having a front end portion in respect of the paper feeding direction adapted to be removably mounted into a side hole of a body of a printer, the cassette case having an upper opening from which a plurality of sheets of paper are to be supplied and accommodated in a stacked condition; a fixed cover fixed to a front portion of the upper opening of the cassette case; a rotatable cover for covering a rear portion of the upper opening of the cassette case behind the fixed cover; a pair of supporting portions located near a rear end portion of the fixed cover for vertically rotatably supporting a front end portion of the rotatable cover on opposite side surfaces thereof; and a pair of manual feed guides located on an upper surface of the fixed cover at laterally opposite positions for guiding opposite side edges of a manual feed paper. Accordingly, when the cassette case is mounted into the side hole of the body of the printer, the front ends of the manual feed guides can be located close to the paper feed roller in the body. Accordingly in feeding the manual feed paper along the upper surface of the fixed cover into the body of the printer, the inclination of the front end of the manual feed paper, which causes the skewing, can be prevented. Furthermore, the rotatable cover can be opened with its rear end raised and with a change in position of its front end prevented. Accordingly, the interference of the front end of the rotatable cover with the sheets of paper can be prevented upon supplying the sheets into the cassette case.

What is claimed is:

1. A paper feed cassette comprising:

a cassette case having a front end portion in respect of the paper feeding direction adapted to be removably mounted into a side hole of a body of a printer, said cassette case having first and second side walls which form therebetween an upper opening from which a plurality of sheets of paper are to be supplied and accommodated in a stacked condition;

a fixed cover fixed to said first and second side walls at a front portion of the upper opening of said cassette case, said fixed cover having a rearward edge with a cut-out portion adjacent each of said first and second side walls such that a central portion of the fixed cover extends farther rearwardly than portions of the fixed cover adjacent to the first and second sidewalls;

a rotatable cover for covering a rear portion of the upper opening of said cassette case behind said fixed cover, said rotatable cover having a leg extending in a complementary fashion into each of said cut-outs in said fixed cover;

a pair of supporting portions, one supporting portion provided on each of said first and second walls within one of said cut-out portions of said fixed cover for vertically rotatably supporting each leg of said rotatable cover; and a pair of manual feed guides fixed on an upper surface of said fixed cover at laterally opposite positions for guiding opposite side edges of manual feed paper, said manual feed guides being restrained from moving relative to said fixed cover when said rotatable cover is rotated about said supporting portions;

wherein said cut-out portions, supporting portions, and legs are configured such that a central portion of a forward edge of the rotatable cover is lifted over said manual feed guides by said legs when said rotatable cover is rotated about said supporting portions.

2. The paper feed cassette as defined in claim 1, wherein said manual feed guides are inserted in the body of the printer.

3. The paper feed cassette as defined in claim 1, wherein said manual feed guides are slidably mounted on said fixed cover to accommodate manual feeding of various widths of paper.

4. A paper feed cassette according to claim 3, wherein said manual feed guides are located in the body of the printer when the front end of said cassette case is positioned in the body of the printer.

5. A paper feed cassette according to claim 3, wherein said fixed cover includes an upper surface on which manual feed paper is supported.

6. A paper feed cassette according to claim 3, wherein said fixed cover includes an inclined upper surface toward the front end portion of said cassette case.

7. A paper feed cassette comprising:

a cassette case having a front end portion in respect of a paper feeding direction adapted to be removably mounted into a side hole of a body of a printer, said cassette case having first and second side walls which form therebetween an upper opening through which a plurality of sheets of paper are to be supplied and accommodated in a stacked condition;

a fixed cover fixed to said first and second side walls for covering a front portion of the upper opening of said cassette case;

a rotatable cover for covering a remaining portion of the upper opening of said cassette case;

a pair of first and second legs each having a defined length, each said first and second legs being positioned adjacent to the corresponding first and second side walls, one of the ends of said first and second legs being respectively fixed to said rotatable cover, the other end of said first and second legs extending toward the front portion of the upper opening of said cassette case, the extended portion of said first and second legs being rotatably supported by supporting portions on the corresponding first and second side walls so as not to interfere with said fixed cover when said first and second legs are rotated upward about said supporting portions; and a pair of manual feed guides formed on said fixed cover so that each of said manual feed guides is oppositely positioned and extends along the paper feed direction to guide opposite sides of manual feed paper, said manual feed guides being restrained from moving relative to said fixed cover when said rotatable cover is rotated with said pair of first and second legs.

* * * * *